United States Patent [19]

Bonander et al.

[11] Patent Number: 4,861,434

[45] Date of Patent: Aug. 29, 1989

[54] EXTENDED NIP PRESS APPARATUS WITH TRACKS TO SLIDEABLY ACCOMMODATE BEADED BLANKET EDGES

[75] Inventors: James Bonander, Clarks Summit, Pa.; Sergio Torza, International Falls, Minn.

[73] Assignee: Beloit Corporation, Beloit, Wis.

[21] Appl. No.: 260,978

[22] Filed: Oct. 21, 1988

[51] Int. Cl.[4] ..... D21F 3/02

[52] U.S. Cl. ..... 162/358; 100/93 RP; 100/118; 100/153; 162/205; 162/272; 162/361

[58] Field of Search ..... 162/205, 199, 358, 360.1, 162/272, 361; 100/118, 153, 154, 93 RP; 29/116.1, 116.2, 113.1, 113.2

[56] References Cited

U.S. PATENT DOCUMENTS

Re. 31,923 6/1985 Justus et al. ..... 162/358
4,707,222 11/1987 Mullner et al. ..... 162/358

FOREIGN PATENT DOCUMENTS 3338487 5/1985 Fed. Rep. of Germany ..... 162/358

*Primary Examiner*—Karen Hastings

*Attorney, Agent, or Firm*—Dirk J. Veneman; Raymond W. Campbell; David J. Archer

[57] ABSTRACT

An extended nip press apparatus is disclosed for pressing water from a web. The apparatus includes a press frame and a backing roll rotatably secured to the frame. An elongate shoe is connected to the frame, the shoe being movable relative to the roll. The shoe defines a concave surface having a lubricant thereon. The concave surface cooperates with the roll for defining therebetween an extended nip. An endless blanket having a first and a second lateral edge is slidable relative to the shoe, the blanket extending contiguously with the web through the nip such that the web is disposed between the blanket and the roll for pressing water from the web. First and second beads are connected to the first and second edges respectively, the beads extending continuously around the respective edges. A first and a second track are rigidly secured in a radial direction to the frame with the tracks slidably accommodating the first and the second beads respectively such that the edges of the blanket are guided by the tracks so that the blanket, the beads, and the tracks cooperate together to define an enclosure for confining the lubricant supplied between the concave surface and the blanket.

14 Claims, 3 Drawing Sheets

EXTENDED NIP PRESS APPARATUS WITH TRACKS TO SLIDEABLY ACCOMMODATE BEADED BLANKET EDGES

BACKGROUND OF THE INVENTION

FIELD OF THE INVENTION

The present invention relates to an extended nip press apparatus for pressing water from a web. More particularly, the present invention relates to an endless blanket for an extended nip press apparatus, the blanket having a first and a second bead connected to the respective lateral edges of the blanket, the beads being slidably accommodated within tracks for confining lubricant supplied between the shoe and the blanket.

INFORMATION DISCLOSURE STATEMENT

The so-called "Apple" extended nip press includes a backing roll and an extended nip press shoe defining a concave surface which cooperates with the backing roll for defining therebetween an extended nip. A bearing blanket extends contiguously with a felt and web through the extended nip with the web disposed between the backing roll and the blanket such that for an extended period, water is pressed from the web during passage through the nip.

In the "Apple" extended nip press, the blanket when viewed from the side of the extended nip press apparatus follows a generally apple-shaped configuration with the blanket following a substantially circular path until the blanket dips through the extended nip.

In view of the very high pressures exerted on the blanket by the shoe, lubricating oil is supplied between the shoe and the inner surface of the blanket for facilitating slidable movment of the blanket through the extended nip.

Although various arrangements have been proposed for supplying the aforementioned lubricant to the shoe and for recovering such lubricant from the inner surface of the blanket, various problems have presented themselves as a result of the use of such lubricant.

First, in use of the apparatus at high speed, the lubricant tends to form an oil mist which drifts laterally away from the apparatus to form an oily deposit on ancillary equipment. Such oily deposit presents a hazard to personnel operating the extend nip press apparatus as such deposited lubricant renders guard rails and access walkways slippery.

Second, the aforementioned lubricant mist poses a potential fire hazard in the vicinity of the extended nip press apparatus.

Third, there exists a tendency for the lubricant to creep around the lateral edges of the blanket and onto the outer surface thereof thereby contaminating the felt and the pressed web.

In an attempt to confine the lubricant within the blanket, several proposals have been presented including various seals for engaging the lateral edges of the blanket. West German patent application No. 3338487 published May 2, 1985 to Escher-Wyss describes a seal connected to a rotatable head to define an enclosure for confining oil mist within the blanket. However, in the Escher-Wyss disclosure, the blanket tends to bend in a cross-machine direction during passage of the blanket through the extended nip. Such cross-machine direction bending in addition to the machine direction bending of the blanket as the blanket moves through the extended nip imposes excessive torsional stresses on the blanket leading to premature failure of the same.

The present invention provides a simple solution to the aforementioned problem of oil mist containment while avoiding cross-machine direction bending of the blanket by providing beads on the lateral edges of the blanket, the beads being guided by tracks.

Therefore it is a primary object of the present invention to overcome the aforementioned inadequacies of the prior art proposals and to provide an extended nip press apparatus that makes a considerable contribution to the art of pressing water from a web.

SUMMARY OF THE INVENTION

The present invention relates to an extended nip press apparatus and method for pressing water from a web. The apparatus includes a press frame and a backing roll rotatably secured to the frame. An elongate shoe is connected to the frame with the shoe being movable relative to the roll. The shoe defines a concave surface having a lubricant thereon, the concave surface cooperating with the roll for defining therebetween an extended nip. An endless blanket having a first and a second lateraal edge is slidable relative to the shoe and extends contiguously with the web through the nip such that the web is disposed between the blanket and the roll for pressing water from the web. First and second beads are connected respectively to the first and the second edges with the beads extending continuously around the respective edges. A first and a second track are rigidly secured in a radial direction to the frame with the tracks slidably accommodating the first and the second beads respectively such that the edges of the blanket are guided by the tracks so that the blanket, the beads and the tracks cooperate together to define an enclosure for confining the lubricant supplied beteween the concave surface and the blanket.

More particularly, the endless blanket describes in use of the apparatus an apple-shaped configuration and is fabricated from randomly oriented fibers dispersed in urethane.

The beads are of circular cross-sectional configuration and in one embodiment of the present invention the beads are of unitary construction. Each of the beads includes a laterally extending ear with the ear being connected to a respective edge of the blanket.

In another embodiment of the present invention, each of the beads defines a longitudinal slot for the reception therein of a respective edge of the blanket.

In another embodiment of the present invention, each of the beads is integrally constructed with the blanket.

In a preferred embodiment of the present invention, each of the tracks follows the edges of the blanket such that when the blanket moves in a generally circular configuration and then through the extended nip, the blanket does not bend in a cross-machine direction.

The press apparatus also includes a first and second spacer with the first spacer disposed between the first track and the frame and the second spacer disposed between the second track and the frame. The spacers maintain the respective tracks at a distance from the frame such that the tracks follow the edges of the blanket so that the blanket does not bend in a cross-machine direction during passage of the blanket through the extended nip.

In one embodiment of the present invention, the press apparatus includes means for urging the spacers outwardly away from the shoe so that the blanket is maintained taut during passage of the blanket through the nip.

In the preferred embodiment of the present invention, the first and the second tracks define respectively first and second channels of substantially circular cross-sectional configuration for the reception therein of the first and the second beads respectively. The cross-sectional configuration of the channels is greater than the cross-sectional configuration of the beads such that movement of the beads within the respective channels is facilitated.

The first track includes a first and a second element, the first and second elements defining a first and second portion respectively of the first channel such that the first and second elements cooperate together to define the first channel. Similarly, the second track includes a third and fourth element. The third and fourth elements define a third and fourth portion of the second channel such that the third and fourth elements cooperate together to define the second channel.

The first and the second elements define respectively a first and a second lip such that when the first bead is disposed within the first channel, the first and second lips slidably anchor the first bead within the first channel. Additionally, the third and fourth elements define respectively a third and fourth lip such that when the second bead is disposed within the second channel, the third and fourth lips slidably anchor the second bead within the second channel.

Many variations and modifications of the present invention will be apparent to those skilled in the art by a consideration of the detailed description contained hereinafter taken in conjunction with the annexed drawings. However, such modifications and variations fall within the spirit and scope of the present invention as defined by the appended claims.

BRIEF DESCRIPTION OF THE DRAWINGS

Similar reference characters refer to similar parts throughout the various embodiments of the present invention.

DETAILED DESCRIPTION OF THE DRAWINGS

Figure 1:
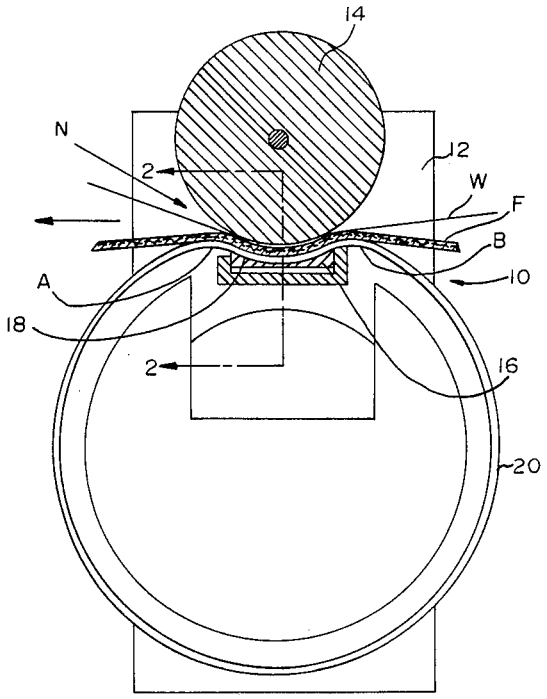
FIG. 1 is a side-elevational view partially in section of an "Apple-type" extended nip press according to the present invention.

FIG. 1 is a side-elevational view partially in section of an extended nip press apparatus generally designated 10 for pressing water from a web W. The apparatus 10 includes a press frame 12 and a backing roll 14 rotatably secured to the frame 12. An elongate shoe 16 is connected to the frame 12. The shoe 16 is movable relative to the roll 14, the shoe 16 defining a concave surface 18 having a lubricant thereon. The concave surface 18 cooperates with the roll 14 for defining therebetween an extended nip generally designated N.

Figure 2:
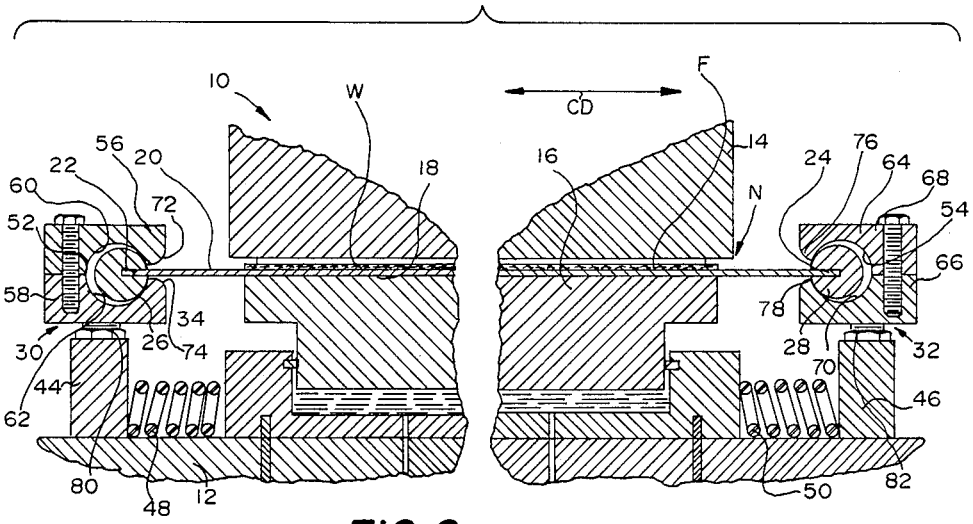
FIG. 2 is an enlarged sectional view taken on the line 2—2 of FIG. 1 showing the first and second edges of the blanket anchored within the first and second tracks.

FIG. 2 is an enlarged sectional view taken on the line 2—2 of FIG. 1 and shows an endless blanket 20 having a first and second lateral edge 22 and 24 respectively. The banket 20 slides relative to the shoe 16 and extends contiguously with the web W through the nip N such that the web W is disposed between the blanket 20 and the roll 14 for pressing water from the web W.

As shown in FIG. 2, a first and second bead 26 and 28 respectively are connected to the first and second edges 22 and 24 respectively. The beads 26 and 28 extend continuously around the respective edges 22 and 24.

A first and second track generally designated 30 and 32 respectively are rigidly secured in a radial direction to the frame 12. The first and second tracks 30 and 32 slidably accommodate the first and second beads 26 and 28 respectively such that the edges 22 and 24 of the blanket 20 are guided by the tracks 30 and 32 so that the blanket 20, the beads 26 and 28, and the tracks 30 and 32 cooperate together to define an eclosure 34 for confining the lubricant supplied between the concave surface 18 and the blancket 20.

As shown in FIG. 1, the endless blanket 20 describes in use of the apparatus an apple-shaped configuration. Furthermore, the endless blanket 20 includes randomly oriented fibers dispersed in urethane as taught in copending patent application Ser. No. 179,086 filed April 8, 1988. All the disclosure of U.S. Ser. No. 179,086 is incorporated herein by reference.

As shown more particularly in FIG. 2, the beads 26 and 28 are of circular cross-sectional configuration.

Figure 3:
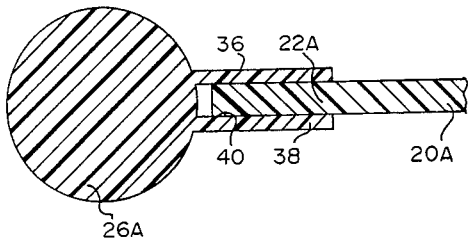
FIG. 3 is an enlarged sectional view of one embodiment of the present invention showing a bead having at least one ear for attachment ot the edge of the blanket.

FIG. 3 is an enlarged sectional view of a bead 26A according to one embodiment of the present invention in which the bead 26A is of unitary construction. The bead 26A includes a lateral ear 36 which is connected to the edge 22A of the blanket 20A. A further ear 38 also extends from the bead 26A, the further ear 38 being parallel and spaced relative to the ear 36 to define a recess 40 for the reception therein of the edge 22A of the blanket 20A.

Figure 4:
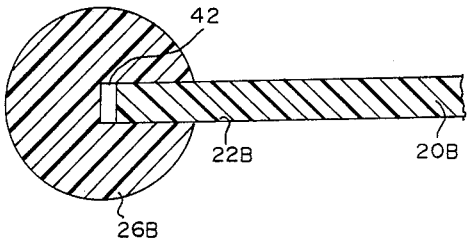
FIG. 4 is a view similar to FIG. 3 but showing a bead having a slot for the reception therein of the edge of the blanket.

FIG. 4 is an enlarged sectional view of an alternative embodiment of the present invention showing a bead 26B which defines a longitudinal slot 42 for the reception therein of an edge 22B of a blanket 20B.

Figure 5:
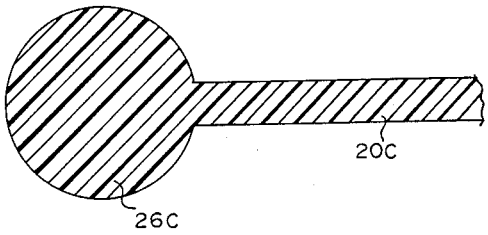
FIG. 5 is a view similar to that shown in FIG. 3 but showing a bead integrally formed with the blanket.

FIG. 5 is an enlarged sectional view of a further alternative embodiment of the present invention in which a bead 26C is integrally constructed with a blanket 20C.

As shown in FIGS. 1 and 2, each of the tracks 30 and 32 follows the edges 22 and 24 respectively of the blanket 20 such that when the blanket 20 moves in a generally circular configuration between the points A and B as shown in FIG. 1 and then through the extended nip N, the blanket 20 does not bend in a cross-machine direction CD as shown in FIG. 2.

As shown in FIG. 2, the apparatus 10 also includes a first and second spacer 44 and 46. The first spacer 44 is disposed between the first track 30 and the frame 12 and the second spacer 46 is disposed between the second track 32 and the frame 12. The spacers 44 and 46 maintain the respective tracks 30 and 32 at a radial distance from the frame 12 such that the tracks 30 and 32 follow the edges 22 and 24 of the blanket 20 so that the blanket 20 does not bend in a cross-machine direction CD during passage of the blanket 20 through the extended nip N.

As shown in FIG. 2, the apparatus 10 also includes means such as compression springs 48 and 50 for urging the spacers 44 and 46 outwardly away from the shoe 16 so that the blanket 20 is maintained taut during passage of the blanket 20 through the nip N.

The first and second tracks 30 and 32, as shown in FIG. 2, define respectively first and second channels 52 and 54 of substantially circular cross-sectional configuration for the reception therein of the first and second beads 26 and 28 respectively. The cross-sectional configuration of the channels 52 and 54 are greater than the cross-sectional configuration of the beads 26 and 28 such that movement of the beads 26 and 28 within the respective channels 52 and 54 is facilitated.

As shown in FIG. 2, the first track 30 includes a first and second element 56 and 58 with the elements 56 and 58 defining a first and second portion 60 and 62 of the first channel 52 such that the first and second elements 56 and 58 cooperate together to define the first channel 52.

Similarly, the second track 32 includes a third and fourth element 64 and 66 respectively. The elements 64 and 66 define a third and fourth portion 68 and 70 of the second channel 54 such that the third and fourth elements 64 and 66 cooperate together to define the second channel 54.

FIG. 2 shows the first and second elements 56 and 58 defining respectively a first and second lip 72 and 74 such that when the first bead 26 is disposed within the first channel 52, the first and second lips 72 and 74 slidably anchor the first bead 26 within the first channel 52. The third and fourth elements 64 and 66 define respectively a third and fourth lip 76 and 78 such that when the second bead 28 is disposed within the second channel 54, the third and fourth lips 76 and 78 slidably anchor the second bead 28 within the second channel 54.

In operation of the apparatus, as shown in FIGS. 1 and 2, when the backing roll 14 rotates, the web W and a felt F together with the blanket 20 move through the extended nip N with the web W disposed between the backing roll 14 and the blanket 20. However, the respective edges 22 and 24 of the blanket 20 are guided by the channels 52 and 54 respectively such that the blanket 20 is always disposed in the same cross-machine direction plane as the blanket moves through the extended nip. The aforementioned arrangement not only defines an enclosure 34 for the containment of lubricant mist but also inhibits bending of the edges of the blanket that extend laterally away from the shoe 16.

In order to accommodate the variation in location of the shoe 16 relative to the backing roll 14 according to the pressing requirements for various paper grades, the distance between the frame and the respective track as shown in FIG. 2 may be adjusted by threaded rods 80, 82 respectively to compensate for such variations and to maintain the blanket 20 without any cross-machine directional bends therein.

Figure 6:
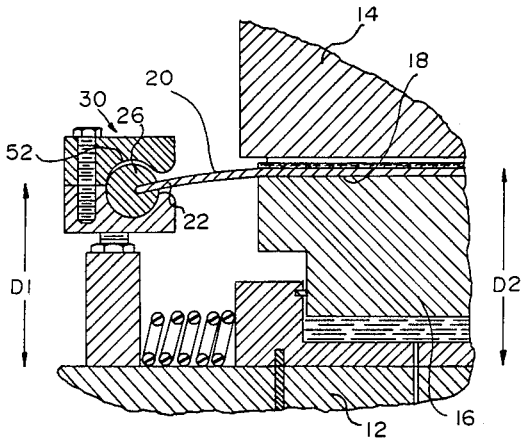
FIG. 6 is a fragmentary sectional view similar to FIG. 2 but showing the blanket bent downwardly.
Figure 7:
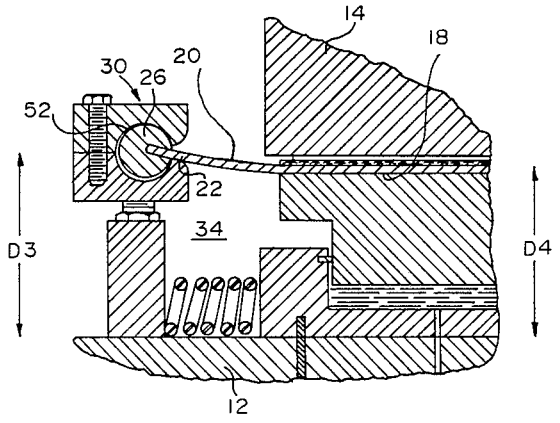
FIG. 7 is a fragmentary sectional view similar to FIG. 2 but showing the blanket bent upwardly.

However, in the event of slight variations in the distance between the tracks 30 and 32 and the frame 12 and the concave surface 18 and the frame 12, the beads 26 and 28 accommodated within the respective channels 52 and 54 permit slight bending of the blanket as shown in FIGS. 6 and 7. FIGS. 6 and 7 are similar views to that shown in FIG. 2 but show an exaggerated cross-machine direction bending of the blanket 20.

More particularly, FIG. 6 shows the distance D1 between the first track 30 and the frame 12 as being less than the distance D2 between the concave surface 18 and the frame 12. Therefore the slight downward bending of the first edge 22 is accommodated by a slight counterclockwise rotation of the bead 26 within the channel 52.

Similarly, as shown in FIG. 7, the distance D3 between the first track 30 and the frame 12 is greater than the distance D4 between the concave surface 18 and the frame 12 resulting in a slightly upward bending of the first edge 22 of the blanket 20. Such upward bending is accommodated by a slight clockwise rotation of the bead 26 within the channel 52 while maintaining complete sealing of the enclosure 34.

The present invention provides a simple and inexpensive means for sealing an extended nip press blanket for containing lubrican mist within the blanket.

What is claimed is:

1. An extended nip press apparatus for pressing water from a web, said apparatus comprising:

a press frame;

a backing roll rotatably secured to said frame;

an elongate shoe connected to said frame, said shoe being movable relative to said roll, said shoe defining a concave surface having a lubricant thereon, said concave surface cooperating with said roll for defining therebetween an extended nip;

an endless blanket having a first and second lateral edge, said blanket sliding relative to said shoe, and extending contiguously with the web through said nip, such that the web is disposed between said blanket and said roll for pressing water from the web, said lubricant being supplied between said concave surface and said blanket;

first and second beads connected to said first and second edges respectively, said beads extending continuously around said respective edges; and a first and second track rigidly secured in a radial direction to said frame, said first and second tracks constructed an arranged so as to slidably accommodate said first and second beads respectively, such that said edges of said blanket are guided by said tracks so that said blanket, said beads, and said tracks cooperate together to define an enclosure for confining said lubricant supplied between said concave surface and said blanket.

2. An extended nip press apparatus as set forth in claim 1 wherein said endless blancket describes in use of the apparatus, an apple-shaped configuration.

3. An extended nip press apparatus as set forth in claim 1 wherein said endless blanket includes:

randomly oriented fibers dispersed in urethane.

4. An extended nip press apparatus as set forth in claim 1 wherein said beads are of circular cross-sectional configuration.

5. An extended nip press apparatus as set forth in claim 1 wherein said beads are of unitary construction, each of said beads including:

a laterally extending ear, said ear being connected to said respective edge of said blanket.

6. An extended nip press apparatus as set forth in claim 1 wherein each of said beads defines a longitudinal slot for reception therein of said respective edge of said blanket.

7. An extended nip press apparatus as set forth in claim 1 wherein each of said beads is integrally constructed with said blanket.

8. An extended nip press apparatus as set forth in claim 1 wherein each of said tracks follows said respective edge of said blanket and is structured such that when said blanket moves in a generally circular configuration and then through said extended nip, said blanket does not bend in a cross-machine direction.

9. An extended nip press apparatus as set forth in claim 8 further including:

a first and second spacer disposed respectively between said first and second track and said frame, said spacers maintaining said respective tracks at a distance from said frame such that said tracks follow said edges of said blanket so that said blanket does not bend in a cross-machine direction during passage of said blanket through said extended nip.

10. An extended nip press apparatus as set forth in claim 9 further including:

means for urging said spacers outwardly away from said shoe so that said blanket is maintained taut during passage of said blanket through said nip.

11. An extended nip press apparatus as set forth in claim 4 wherein said first and second tracks define respectively first and second channels of substantially circular cross-sectional configuration for the reception therein of said first and second beads respectively, said cross-sectional configuration of said channels being greater than the cross-sectional configuration of said beads such that movement of said beads within said respective channels is facilitated.

12. An extended nip press apparatus as set forth in claim 11 wherein said first track includes:

a first and a second element, said first and second elements defining a first and second portion respectively of said first channel such that said first and second elements cooperate together to define said first channel;

said second track includes: a third and fourth element, said third and fourth elements defining a third and fourth portion of said second channel such that said third and fourth elements cooperate together to define said second channel.

13. An extended nip press apparatus as set forth in claim 12 wherein said first and second elements define respectively a first and a second lip such that when said first bead is disposed within said first channel, said first and second lips slidably anchor said first bead within said first channel;

said third and fourth elements define respectively a third and fourth lip such that when said second bead is disposed within said second channel, said third and fourth lips slidably anchor said second bead within said second channel.

14. An extended nip press apparatus for pressing water from a web, said apparatus comprising:

a press frame;

a backing roll rotatably secured to said frame;

an elongate shoe connected to said frame, said shoe being movable relative to said roll, said shoe defining a concave surface having a lubricant thereon, said concave surface cooperating with said roll for defining therebetween an extended nip;

an endless blanket having a first and second lateral edge, said blanket sliding relative to said shoe, and extending contiguously with the web through said nip such that the web is disposed between said blanket and said roll for pressing water from the web, said lubricant being supplied between said concave surface and said blanket;

said blanket including randomly oriented fibers disbursed in urethane;

first and second beads connected to said first and second edges respectively, said beads extending continuously around said respective edges;

a first and second track rigidly secured in a radial direction to said frame, said first and second tracks constructed and arranged so as to slidably accommodate said first and second beads respectively such that said edges of said blanket are guided by said tracks so that said blanket, said beads, and said tracks cooperate together to define an enclosure for confining said lubricant supplied between said concave surface and said blanket; and each of said tracks following said respective edge of said blanket and structured such that when said blanket moves through said extended nip, said blanket does not bend in a cross-machine direction.

* * * * *